United States Patent [19]

Berg et al.

[11] Patent Number: 4,633,069

[45] Date of Patent: Dec. 30, 1986

[54] HEAT-EXCHANGER

[75] Inventors: Peter G. Berg, Attleboro Falls; Vishwa Shukla, North Attleboro; Bernard M. Kulwicki, Foxboro; Thomas C. Conlan, Attleboro, all of Mass.

[73] Assignee: Texas Instruments Incorporated, Dallas, Tex.

[21] Appl. No.: 789,579

[22] Filed: Oct. 21, 1985

[51] Int. Cl.[4] ..... H05B 3/12

[52] U.S. Cl. ..... 219/553

[58] Field of Search ..... 219/553, 523

[56] References Cited

U.S. PATENT DOCUMENTS

| | | | |
|---|---|---|---|
| 4,334,148 | 6/1982 | Kampe | 219/553 |
| 4,541,898 | 9/1985 | Mase et al. | 219/553 X |
| 4,544,828 | 10/1985 | Shigenobu et al. | 219/553 X |

FOREIGN PATENT DOCUMENTS

| | | | |
|---|---|---|---|
| 2154407A | 9/1985 | United Kingdom | 219/553 |

*Primary Examiner*—Donald A. Griffin

*Attorney, Agent, or Firm*—James P. McAndrews; John A. Haug; Melvin Sharp

[57] ABSTRACT

A body comprising a ceramic electrical resistance material of positive temperature coefficient of resistivity adapted to display a sharp increase in resistivity when heated to a selected temperature has passages extending through the body between opposite ends of the body for passing fluid through the passages in heat-exchange relationship to the body and has means electrically contacting spaced-apart portions of the body for directing electrical current through the body to self-heat the body. The body is made with an improved structure in an improved manner and is particularly adapted for use as a self-regulated fluid heater within a small or irregularly-shaped conduit or the like.

4 Claims, 10 Drawing Figures

HEAT-EXCHANGER

BACKGROUND OF THE INVENTION

The field of this invention is that of self-regulating electrical resistance heaters and fluid flow sensors and the invention relates more particularly to bodies of ceramic electrical resistance material of positive temperature coefficient of resistivity (PTC) having passages extending through the body which are adapted for heating fluid flowing through the body passages or for sensing change in fluid flow through the passages to display change in resistivity of the body material as an indication of the change in fluid flow.

Ceramic electrical resistance materials of positive temperature coefficient of resistivity which are adapted to display sharply increasing resistivity when heated to a selected temperature are widely used as self-regulating electrical resistance heaters and as thermally-responsive sensors. Such materials are formed in a variety of processes which typically include a first heating step in which precursors of the ceramic material are calcined for producing materials with the desired positive temperature coefficient of resistivity and a second heating step in which the ceramic materials are sintered for forming a body of a desired configuration. It is also well known to form multipassaged bodies of such PTC materials by molding or extruding processes so that the bodies are adapted to pass fluids such as air-fuel mixtures in a carburetor through the body passages in close, heat-transfer relation with the electrical resistance heater material of the body. However, such heater bodies have been difficult and expensive to manufacture particularly in smaller sizes and with irregular shapes and it would be desirable to be able to form such flow-through PTC heaters and sensors with increased porousity in a more economical manner which is more easily adpated to providing desired porousity in a body of small or irregular shape so that the body can be, for example, more easily fitted into conduits and the like for heat exchange with fluids passing in the conduits.

BRIEF SUMMARY OF THE INVENTION

It is an object of this invention to provide a novel and improved heat-exchange body of an electrical resistance material of positive temperature coefficient of resistivity having fluid flow passages extending through that body; to provide a compact heat-exchange body, to provide such a body having high open porosity, with high interpassage heat-transferring surface area, and with serpentine pores or passages adapted to repeatedly intercept fluid flowing through the passages for achieving rapid heat-exchange with the fluid; to provide such a body particularly adapted for high heat transfers to fluids with low fluid flow rates.

It is also an object of this invention to provide a body which is adapted to be manufactured with high porosity in an economical manner; to provide such a body of any desired small or irregular shape; and to provide novel and improved methods for forming such a small irregularly shaped passaged body.

Briefly described, the body comprises a ceramic electrical resistance material of positive temperature coefficient of resistivity which is adapted to display a sharp increase in resistivity when heated to a selected temperature. The body has passages extending through the body between opposite ends of the body for passing fluid through the passages in heat-exchange relationship to the body. The body also has means such as a pair of flame-sprayed aluminum metal contacts electrically engaging spaced-apart portions of the body for directing electrical current through the body to self-heat the body. In accordance with this invention, the body has an improved structure in that it is characterized having a multiplicity of pores or openings in the body material which communicate with each other for defining a plurality of passages of intercommunicating serpentine configuration varying in cross-section along the length of the passages where the passages are entwined with each other within the body to extend between opposite ends of the body, thereby to provide improved porosity and heat-transfer between the body and a fluid passing through the body passages.

In one preferred embodiment of the invention, the body passages are formed by sintering balls of said ceramic material together for securing the balls to each other to form the body while permitting interstices between the balls to communicate with each other for forming passages of the desired configuration extending through the body. In another preferred embodiment of the invention, the body is formed by impregnating a shape-retaining organic foam material with a slurry of a powder of the ceramic material in a fluid carrier. The impregnated organic foam is then heated for depositing the powder on the walls of the passages of the foam, for burning off the foam material and for sintering the deposited powder to form the desired, multipassaged ceramic body. In that way the PTC body is formed with the desired high porosity in a novel and economical manner and the manner of forming the body is adapted to provide the body with any desired small or irregular shape which may be required for fitting within a conduit or the like for heat-exchange purpose with a fluid flowing in the conduit.

DESCRIPTION OF THE DRAWINGS

Other objects, advantages and details of the novel and improved heat-exchange PTC body and methods of this invention for making such a body appear in the following detailed description of preferred embodiments of the invention, the detailed description referring to the drawings in which.

DESCRIPTION OF THE PREFERRED EMBODIMENTS

Figure 1:
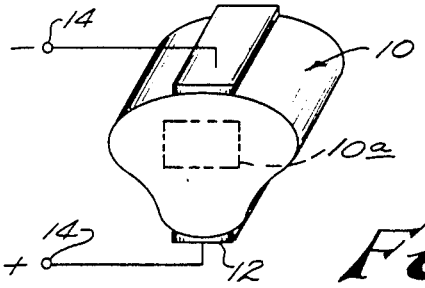
FIG. 1 is a perspective view of the novel and improved small, irregularly-shaped heat-exchange body of this invention.

Referring to the drawings 10 in FIG. 1 indicates a preferred embodiment of the novel and improved heat-exchange body of this invention which is shown to be formed in a small, irregular shape. The body is formed of a ceramic electrical resistance material of a positive temperature coefficient of resistivity (PTC) which is preferably adapted to display a sharp increase in resistivity when heated to a selected temperature so that the body is adapted to self-regulate to stabilize at a selected, safe temperature level when electrically energized as a resistance heater. Electrical contact means 12 are arranged on spaced-apart portions of the body in electrically contacting relation to the ceramic electrical resistance material of the body in a conventional manner for directing electrical current through the body from a power source diagrammatically illustrated by the terminals 14. Alternately the contacts may be forced on the ends of the body without blocking pores in the body and if desired more than one pair of contacts may be used on each body. Preferably the contacts are formed of aluminum which is applied to the body 10 by flame-spraying or the like and which is established in ohmic contact relation to the body by heating of the contact materials in connection with the body in any conventional manner. In accordance with this invention, as is shown in FIG. 2 comprising an enlarged partial plan view of the portion of the body indicated at 10*a* in FIG. 1, and as shown in FIG. 3, the body is characterized by accommodating a multiplicity of openings 16 therein which communicate with each other within the body for defining a plurality of passages as indicated by the arrows 18 in FIG. 3, which passages are of an intercommunicating serpentine configuration varying in cross-section along the length thereof and which are entwined with each other within the body to be accommodated in large number within the body extending between opposite ends 10.1 and 10.2 of the body as illustrated in FIG. 3.

Figure 2:
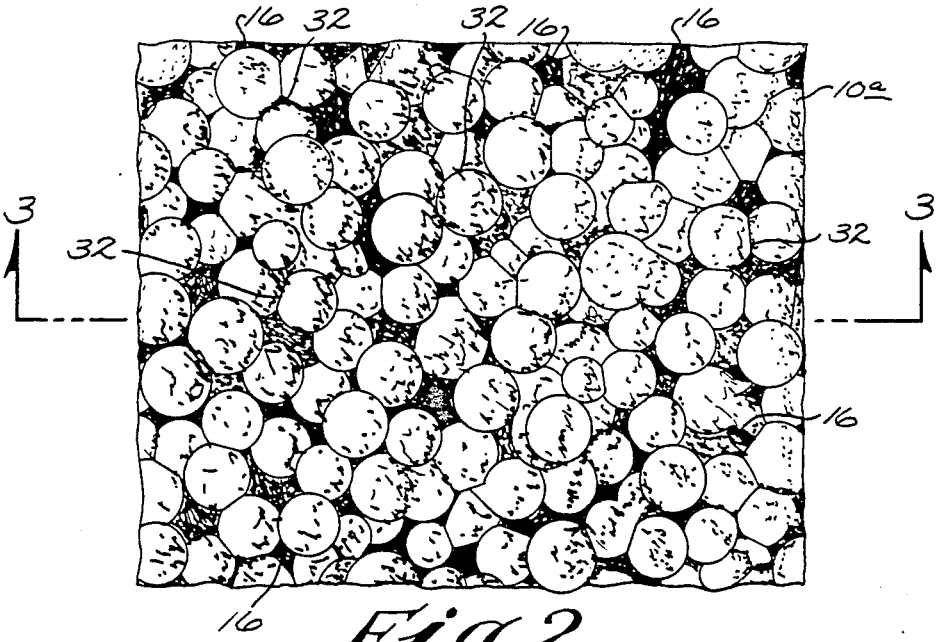
FIG. 2 is a partial plan view of a portion of FIG. 1 to enlarged scale.
Figure 3:
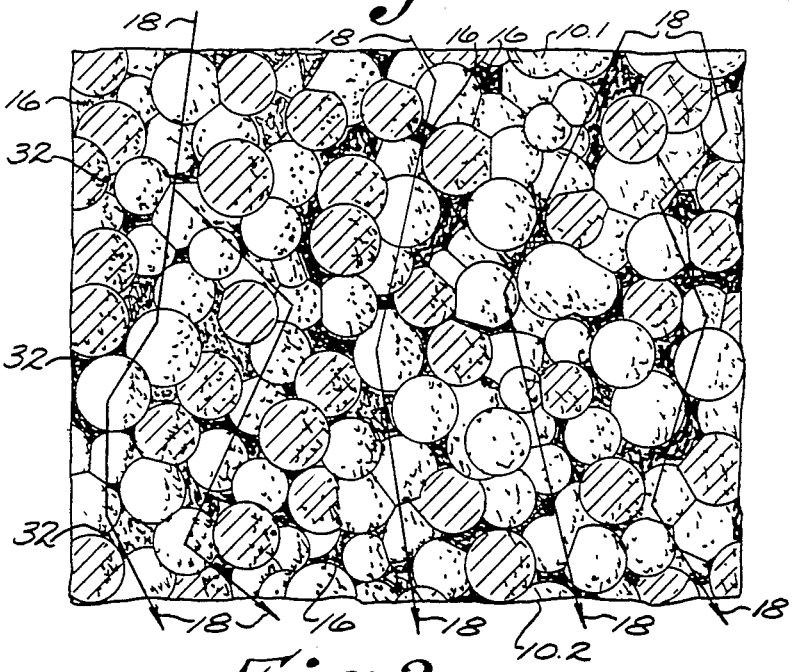
FIG. 3 is a section view along line 3—3 of FIG. 2.
Figure 4A:
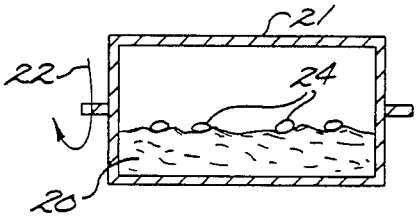
FIGS. 4*a* to 4*c* are diagrammatic views of a preferred embodiment of the novel and improved method of this invention for making the heat-exchange body of FIGS. 1–3.
Figure 4B:
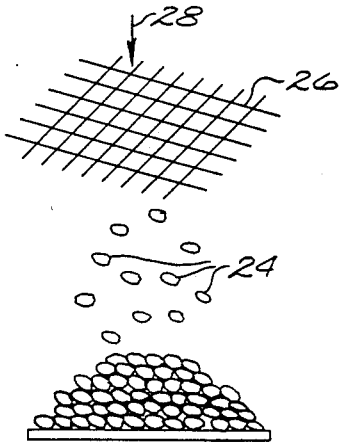
Figure 4C:
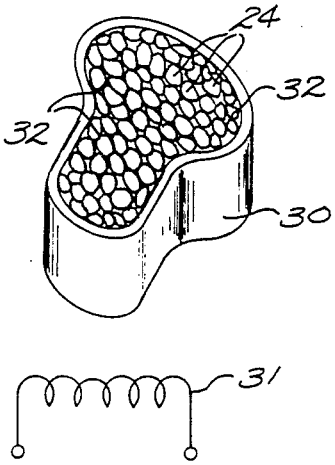

In a preferred method provided by this invention for making the heat-exchange body 10 as illustrated in FIGS. 1–3, the ceramic resistance materials of the body are of any conventional type. Typically for example the resistive material comprises an yttrium doped barium-lead titanate material with a silicon additive having an empirical formula of $Ba_{0.91}\ Pb_{0.09}\ Y_{0.006}\ Si_{0.035}\ (TiO_3)_{1.01}$ as described in U.S. Pat. No. 3,983,077. In accordance with the method of this invention, such a ceramic material as calcined in conventional manner is provided in powder form as indicated at 20 in FIG. 4*a* and is tumbled in conventional tumbling equipment diagrammatically illustrated at 21 as indicated by the arrow 22, thereby to permit agglomeration of the powders into a multiplicity of generally spherical balls 24. For example, where powders having a composition generally corresponding to that as above described are provided in conventional tumbling apparatus in the form of a powder having particle sizes from 0.5 to 30 microns and an average particle size of 1 to 2 microns with about 0.5 to 5 percent moisture content by weight (typically water) for about 1 to 2 hours at room temperature, the powdered materials are agglomerated into a multiplicity of generally spherical balls 24 having diameters in the range from about 0.015 to 0.060 inches. The balls are then sieved as indicated by the sieved 26 and the arrow 28 in FIG. 4*b* for removing oversized and/or undersized balls. The remaining balls of ceramic material are then grouped in a container 30 and are heated therein as is diagrammatically illustrated by the heater means 31 in FIG. 4*c*. In that arrangement, the PTC ceramic balls 24 as grouped in the container 30 each have several points of engagement 32 with adjacent PTC balls in the grouping and the heating of the balls is regulated so that the balls generally retain their spherical shape but are sintered to each other at the points of contact 32 to form the PTC heat-exchange body 10 in the shape of a container 30 with passages 18 of the desired intertwined, serpentine configuration in the body. That is, openings interstices or pores 16 between the balls 24 are interconnected with each other for defining a multiplicity of the passages 18 which intercommunicate with each other in passing between opposite ends 10.1, 10.2 of the body, which are entwined with each other to be accommodated in large number within the body; and which vary in cross-section along the length of the passages for enhancing heat-exchange with a fluid passed through the body passages. As will be understood, the size and the range of the sizes of the spherical balls can be varied as may be desired for providing the sintered PTC ceramic body with a desired degree of porosity in any desired small or irregular shape which is adapted to be received within a conduit or the like of any configuration.

Figure 5:
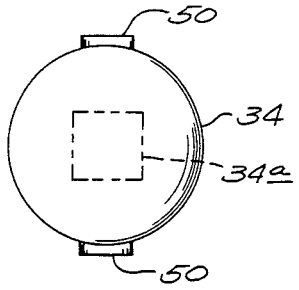
FIG. 5 is a plan view similar to FIG. 1 of another preferred embodiment of the heat-exchange body of this invention.
Figure 6:
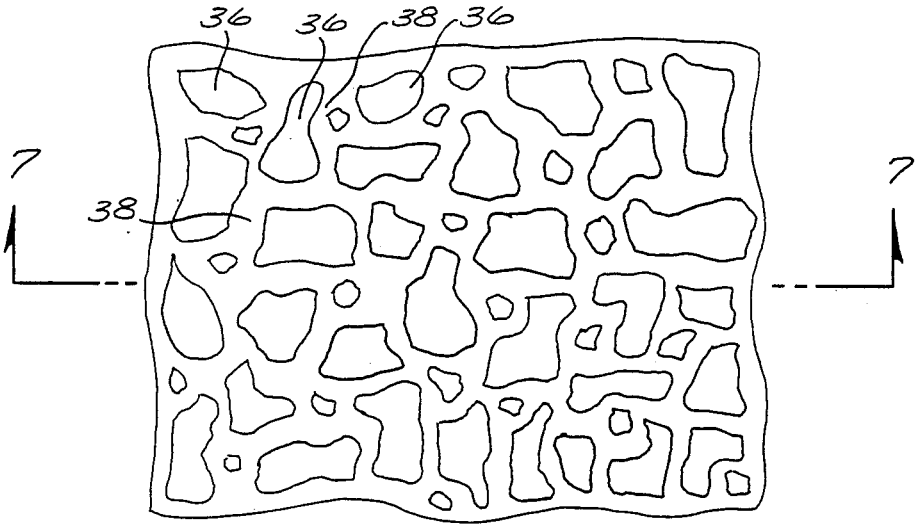
FIG. 6 is a partial plan view of a portion of the heat-exchange body of FIG. 5 illustrated to enlarged scale.
Figure 7:
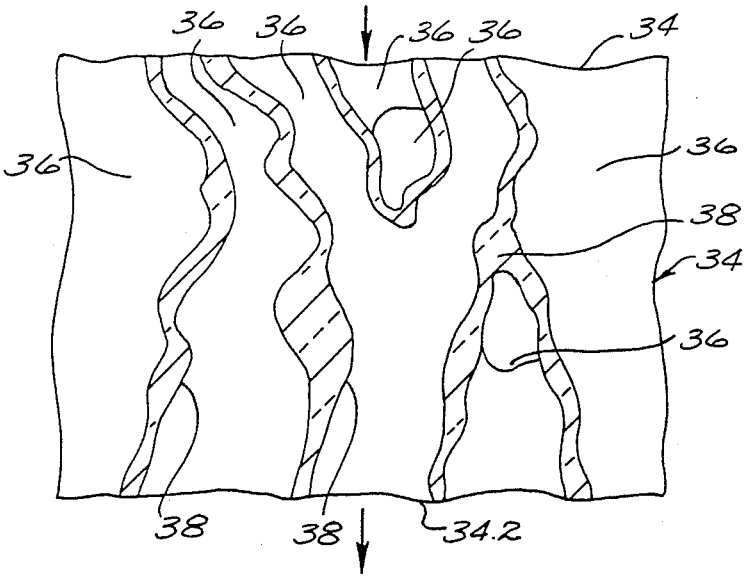
FIG. 7 is a section view along line 7—7 of FIG. 6.

In another preferred embodiment of the novel and improved heat-exchange body of this invention, as indicated at 34 in FIG. 5, the body is formed of ceramic materials corresponding to those above-described and the body has a multiplicity of entwined, intercommunicating serpentine passages which extend between opposite ends 34.1, 34.2 of the body in a corresponding manner. However, because the body 34 is formed in a different manner in another preferred embodiment of the method of this invention, the body 34 tends to have a somewhat different relationship between the size of the body passages 36 and the webs 38 of PTC ceramic material which are provided between the passages as illustrated in FIGS. 6 and 7, FIG. 6 providing an enlarged scale view of a portion 34*a* of the body 34 shown in FIG. 5.

Figure 8:
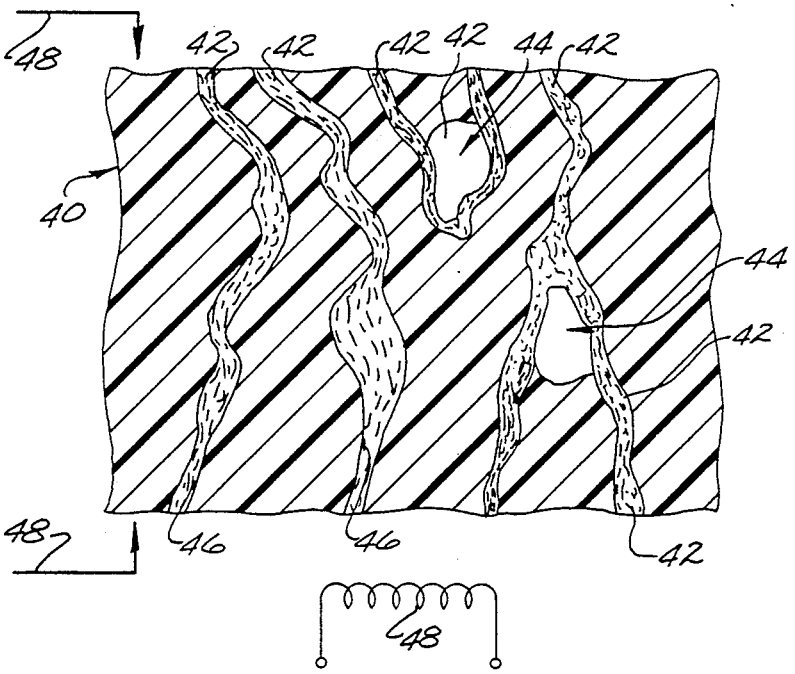
FIG. 8 is a diagrammatic view illustrating another preferred embodiment of the method of this invention particularly adapted for making the heat-exchange body of FIGS. 5–7.

In this other preferred embodiment of the method of this invention, the heat-exchange body 34 is formed by initially providing a body 40 of a conventional organic foam material having a plurality of openings 42 which are interconnected in the foam body to define a plurality of entwined serpentine foam body passages 44 which extend through the body as illustrated in FIG. 8. In accordance with this method invention, a ceramic powder as above-described is provided within a liquid carrier to form a slurry 46 and the foam body 40 is impregnated with the slurry as indicated in FIG. 8 so that the slurry is disposed in the foam body passages as shown. The impregnated foam body is then heated as is diagrammatically illustrated at 48 in FIG. 8 for depositing the ceramic powders on the walls 44.1 of the foam body passages, for sintering the ceramic powder materials together to form the webs 38 of the body 34 as shown in FIG. 7, and for burning off the organic foam body material 40 to lead the passages 36 of the desired configuration in the body 34 as shown in FIG. 7. If desired, the impregnated foam may be compressed as is diagrammatically illustrated by the arrows 48 in FIG. 8 prior to firing for removing excess slurry from within the foam passages leaving the slurry powder deposited uniformly over the walls of the foam passages as will be understood.

For example in this preferred embodiment of the method invention, the foam body 40 comprises a conventional, preferably reticulated, polyurethane foam of high purity such as the foams designated as Scott polyurethane foams obtained from Rogers Foam Incorporated having the designations as indicated in Table 1 below:

TABLE I

| Scott Foam | Pores Per Inch | Foam |
|---|---|---|
| Red | 80 | Reticulated |
| Blue | 60 | " |
| Green | 30 | " |
| Pink | 100 | " |
| White | 100 | " |
| Off-White | 80 | " |
| Yellow (Agouell) | | Non-reticulated |
| Yellow (Custom Double Cell) | | " |
| Black RFI 261 (First) | 45 | Reticulated |
| Black RFI 261 | 60 | " |
| Black RFI 261 | 80 | " |
| Gray RFI 261 | 60 | " |
| Black RFI 261 (Second) | 60 | " |

Such polyurethane foams where found to be of high purity having relatively low impurity levels as indicated in Table II below:

TABLE II

| | Impurities (parts per million) | | | | | | | | | | | |
|---|---|---|---|---|---|---|---|---|---|---|---|---|
| Scott Foam | Al | Ba | Ca | Cr | Cu | Fe | K | Mg | Na | P | Si | Ti |
| Red | 17 | — | 20 | — | 28 | 69 | — | — | 22 | 26 | 6 | — |
| Blue | 13 | 45 | 25 | 7 | 99 | 162 | — | 6 | 6 | 38 | 6 | — |
| Green | — | — | 8 | — | — | 26 | — | — | — | — | 9 | — |
| Pink | 14 | 12 | 161 | 25 | — | 18 | 16 | 121 | 58 | 39 | 23 | — |
| White | 115 | — | 326 | 21 | — | 279 | — | 299 | 59 | 34 | 18 | 2730 |
| Off-white | 402 | 12 | 502 | 32 | — | 68 | 141 | 217 | 215 | 1580 | 30 | 17 |
| Yellow (Agouell) | 20 | — | 26 | — | 163 | 169 | — | 6 | 9 | 27 | 24 | — |
| Yellow | 10 | 11 | 26 | — | — | 8 | — | — | 6 | — | 9 | — |
| Black RFI 261 | 15 | x | 16 | 6 | 6 | 30 | 9 | — | 21 | — | 75 | x |
| Black RFI 261 (1st) | 35 | x | 55 | 6 | 9 | 56 | 12 | 14 | 52 | 6 | 68 | x |
| Black RFI 261 | 12 | x | 12 | 6 | 6 | 41 | — | — | 44 | — | 15 | x |
| Gray RFI 261 | 7 | — | 19 | — | — | 19 | — | — | — | — | 13 | — |
| Black RFI 261 (2nd) | 56 | 31 | 52 | — | 12 | 118 | 11 | 11 | 28 | — | 60 | 15 |

In preparing heat-exchange bodies 34, using these materials, several cylindrical pieces of the black and gray RFI 261 foams about 22 millimeters in diameter and about 12 millimeters thick were cut. If desired a concentric foam pad of one porosity can be placed within a ring of foam of another porosity as indicated by the broken line **34*b* in FIG. 5 to provide a body with areas of different porosity. Using ceramic PTC powders of compositions corresponding to those described above, the powders were calcined and sieved in conventional manner to an average particle size of about 1.68 microns. About 100 grams of the powder were blended with water, methyl cellulose and conventional binders for forming a slurry of about 79.8% solids having a viscosity of about 1500 centipoises. The foam pieces were then impregnated with the slurry by being repeatedly compressed within the slurry and, after removal of the pieces from the slurry, the pieces were compressed to about 25% of their original thickness to remove excess slurry from the foam. The foam pieces were then dried for about one hour at 100° C. in a forced air, convection oven. The impregnated foam pieces were then fired in a kiln at about 1325° C. for depositing the powder on the walls of the foam body passages, for burning out the foam and binder materials, and for sintering the ceramic powders together to form the body 34 having passages therein as illustrated in FIG. 7. The fired parts experienced a linear shrinkage of about 22% and were typically 17 millimeters in diameter and 9.4 millimeters thick and had a density of about 1.12 grams per cubic centimeter corresponding to about 18 to 22% of theoretical density (or having 78 to 82% porosity) while providing bodies of high strength. Other bodies with porosities of up to 95% were found to be somewhat weaker but still of suitable strength for many purposes. Contact means 50 are then applied to the bodies 34 in conventional manner. As thus formed, the heat exchange bodies 34 are adapted to provide excellent heat-exchange with fluid passed through the body passages between ends 34.1, 34.2 of the body and are adapted to generate substantial amounts of heat when electrically energized between the contacts 50** for transferring that heat to the fluid flowing in the passages.

It should be understood that although particular embodiments of the methods and heat-exchange bodies of this invention have been described by way of illustrating the invention, this invention includes all modifications and equivalents of the disclosed embodiments falling within the scope of the appended claims.

We claim:

1. A body comprising a ceramic electrical resistance material of positive temperature coefficient of resistivity adapted to display a sharp increase in resistivity when heated to a selected temperature having passages extending through the body between opposite ends of the body for passing fluid through the passages in heat-exchange relationship to the body, and means electrically contacting spaced-apart portions of the body for directing electrical current through the body to self-heat the body, characterized in that the body accommodates a multiplicity of openings therein interconnected with each other for defining a plurality of said passages of intercommunicating serpentine configuration varying in cross-section along the length thereof entwined with each other within the body for providing improved heat-transfer between the body and a fluid passed through the body passages.

2. A body according to claim 1 further characterized in that the body is formed by grouping a multiplicity of substantially spherical balls of said ceramic material together so each ball has points of engagement with a plurality of other balls defining openings therebetween, and by sintering the ceramic materials for joining the balls together at said points of engagement to form said body having said plurality of passages of intercommunicating serpentine configuration varying in cross-section along the length thereof entwined with each other within the body.

3. A body according to claim 2 further characterized in that said balls are formed by tumbling a powder of said ceramic material for forming spherical agglomerates of said ceramic material, and the spherical agglomerates are heated for sintering the ceramic ball agglomerates to each other for forming said heat-exchange body.

4. A body according to claim 1 further characterized in that the body is formed by providing a shape-retaining foam of an organic material having a multiplicity of openings therein communicating with each other for defining a plurality of intercommunicating passages of serpentine configuration varying in cross-section along the length thereof entwined with each other within the body, impregnating the foam with a slurry embodying a powder of said ceramic material in a fluid carrier for depositing said material on the foam material within said passages, and heating the impegnated foam to burn off the organic material of the foam and center the ceramic powder to form said body having said plurality of body passages of intercommunicating serpentine configuration varying in cross section along the length thereof entwined with each other within the body.

* * * * *